US012616322B2

(12) United States Patent
Yu

(10) Patent No.: US 12,616,322 B2
(45) Date of Patent: May 5, 2026

(54) MODULAR COMPARTMENT PILLOW WITH MULTI-LAYERED PADS

(71) Applicant: Jia Wei Yu, York (CA)

(72) Inventor: Jia Wei Yu, York (CA)

( * ) Notice: Subject to any disclaimer, the term of this patent is extended or adjusted under 35 U.S.C. 154(b) by 178 days.

(21) Appl. No.: 18/330,132

(22) Filed: Jun. 6, 2023

(65) Prior Publication Data

US 2023/0389732 A1 Dec. 7, 2023

Related U.S. Application Data

(60) Provisional application No. 63/349,283, filed on Jun. 6, 2022.

(51) Int. Cl.
*A47G 9/10* (2006.01)
*A47C 7/38* (2006.01)

(52) U.S. Cl.
CPC ..... *A47G 9/10* (2013.01); *A47C 7/38* (2013.01); *A47C 7/383* (2013.01); *A47G 2009/1018* (2013.01); *A47G 9/1027* (2013.01); *A47G 9/1081* (2013.01)

(58) Field of Classification Search
CPC .. A47C 7/383; A47C 7/38; A47G 9/10; A47G 2009/1018; A47G 9/1081; A47G 9/1027; A47G 2009/003; A47G 9/0253
USPC ..... 5/636, 640, 645, 632, 718
See application file for complete search history.

(56) References Cited

U.S. PATENT DOCUMENTS

| | | | | |
|---|---|---|---|---|
| 3,757,364 | A | 9/1973 | Downing | |
| 5,016,303 | A | 5/1991 | Tanaka et al. | |
| 5,644,810 | A | 7/1997 | Kato | |
| 5,809,597 | A | 9/1998 | Shaw | |
| 6,131,219 | A | 10/2000 | Roberts | |
| 7,681,263 | B1 | 3/2010 | Hawkins | |
| 9,775,451 | B1 | 10/2017 | Chon et al. | |
| 9,844,284 | B1 | 12/2017 | Chon et al. | |
| 10,806,279 | B2 | 10/2020 | Berney et al. | |
| 10,925,420 | B2 | 2/2021 | Noble | |
| 11,141,009 | B1 * | 10/2021 | Rane | A47G 9/10 |
| 2001/0003219 | A1 | 6/2001 | Chou | |
| 2005/0217029 | A1 | 10/2005 | Funatogawa | |
| 2006/0075562 | A1 * | 4/2006 | DiGirolamo | A47G 9/10 5/636 |
| 2008/0086818 | A1 | 4/2008 | Sramek et al. | |
| 2011/0252567 | A1 | 10/2011 | Yu | |

(Continued)

FOREIGN PATENT DOCUMENTS

| | | | |
|---|---|---|---|
| CN | 201452509 U | * | 5/2010 |
| CN | 103705045 A | | 4/2014 |

(Continued)

OTHER PUBLICATIONS

Leesa, "Hybrid Pillow", webpage, leesa.com, https://www.leesa.com/products/leesa-hybrid-pillow.

(Continued)

*Primary Examiner* — Justin C Mikowski
*Assistant Examiner* — Deborah Talitha Gedeon
(74) *Attorney, Agent, or Firm* — Jacob M. Ward; Ward Law Office LLC

(57) ABSTRACT

A modular compartment pillow includes a main body, a plurality of compartments housed in a cavity in the main body, and at least one opening. The opening provides access to at least one compartment.

20 Claims, 4 Drawing Sheets

(56) References Cited

U.S. PATENT DOCUMENTS

| | | | | |
|---|---|---|---|---|
| 2012/0066837 | A1* | 3/2012 | Thorsen | A47G 9/10 5/652 |
| 2012/0284924 | A1 | 11/2012 | Pratt et al. | |
| 2013/0191998 | A1 | 8/2013 | Wootten, Jr. | |
| 2013/0263377 | A1* | 10/2013 | Wootten, Jr. | A47C 27/15 5/640 |
| 2014/0196214 | A1 | 7/2014 | Dupré | |
| 2016/0213176 | A1* | 7/2016 | Clemente, II | A47G 9/1081 |
| 2017/0055719 | A1* | 3/2017 | Booska | A47C 21/046 |
| 2018/0064253 | A1 | 3/2018 | DeMore et al. | |
| 2020/0367672 | A1 | 11/2020 | Ryan | |
| 2020/0405080 | A1* | 12/2020 | Carmichael | A47G 9/0253 |

FOREIGN PATENT DOCUMENTS

| | | | | |
|---|---|---|---|---|
| CN | 104970637 | A | 10/2015 | |
| CN | 204862343 | U | 12/2015 | |
| CN | 212233958 | U | 12/2020 | |
| JP | 7389994 | B2 * | 12/2023 | A47G 9/10 |
| KR | 20100015034 | A | 2/2010 | |
| WO | 2019139873 | A1 | 7/2019 | |

OTHER PUBLICATIONS

Helix, "Adjustable Pillow", webpage, helixsleep.com, https://helixsleep.com/products/pillow.

Sleepgram, "Sleepgram 3-in-1 Adjustable Queen Bed Pillow 2-pack", webpage, hsn.com, No. 779-463, https://www.hsn.com/products/sleepgram-3-in-1-adjustable-queen-bed-pillow-2-pack/20228728.

Pancake Pillow, "Pancake Pillow The Adjustable Layer Pillow. Custom Fit Your Perfect Pillow Height. Queen Size Luxury Pillow", webpage, amazon.com, Asin BOOOMOYH6W, Item model No. FBA_B00OMOYH6W, Oct. 17, 2014, https://www.amazon.com/Pancake-Pillow-Adjustable-Pillow-Perfect/dp/B00OM0YH6W?th=1.

Three Geese, "Three Geese Adjustable Layer Goose Feather Pillow, Assembled Bed Pillow, 100% Soft Cotton Cover, Good for Side and Back Stomach Sleeper, Standard/Queen Size,Packaging Include 1 Pillow", webpage, amazon.com, Asin B07VRBM3GS, Jul. 26, 2019, China, https://www.amazon.com/Three-Geese-Adjustable-Egyptian-Packaging/dp/B07VRBM3GS/ref=pd_bxgy_img_1/143-8999276-1304941?pd_rd_w=yZrUQ&pf_rd_p=6b3eefea-7b16-43e9-.

Purple, "Purple Pillow, The Most Supportive Pillow Science can Dream up, Adjustable boosters for Personalized Height, Made with GelFlex Grid", webpage, amazon.com, Asin B0884ZVCG7, May 5, 2020, US, https://www.amazon.com/dp/B0884ZVCG7/ref=sspa_dk_detail_4?psc=1&pd_rd_i=B0884ZVCG7&pd_rd_w=Jgnif&pf_rd_p=57cbdc41-b731-4e3d-aca7-49078b13a07b&pd_rd_wg=NhddP&pf_rd_r=CHRNFRWF6XYH967AN788&pd_rd_r=e4856b89-3326-4a77-9aea-.

Sleep Number, "Plushcomfort™ Pillow", webpage, sleepnumber.com, https://www.sleepnumber.com/products/pillow-pcp?Size=Standard&Shape=Ultimate&acid=shopping&ascid=Google%2BNational-_-google-_-SHOPPING_Bedding_Smart-_--_-507146079567-_--_-pla-344346403590-_-mediacode-_-Shopping-_-Shopping&key=&s_kwcid=AL!6200!3!507146079567!!!u!344346403590!&k_clickid=go_cmp-12565058326_adg-123209021647_ad-507146079567_pla-344346403590_dev-c_ext-.

Written Opinion of the International Searching Authority dated Oct. 20, 2023.

* cited by examiner

MODULAR COMPARTMENT PILLOW WITH MULTI-LAYERED PADS

CROSS-REFERENCE TO RELATED APPLICATIONS

This application claims the benefit of U.S. Provisional Application Ser. No. 63/349,283, filed on Jun. 6, 2022. The entire disclosure of the above application is incorporated herein by reference.

FIELD

The present invention relates generally to a pillow and, more particularly, to a modular compartment pillow.

INTRODUCTION

This section provides background information related to the present disclosure which is not necessarily prior art.

Various conditions such as pain, stiffness, sleep apnea, insomnia, snoring, and acid reflux may be associated with or aggravated by improper head or neck positioning during sleep. Pillows that are too thick or too stiff can strain the human body, which can result in general pain, muscle aches, and obstruction to the airway. Conversely, pillows without sufficient support can also result in pain, strained muscles, reduced airflow, and headaches.

Pillows are typically designed to conform to the generalized needs of the entire market. However, there are numerous variations of pillows intended to meet specific needs. These variations include different sizes, shapes, levels of firmness, and fill materials. Some variations are designed for a specific purpose, such as a neck support pillow, and are seldom used. Other variations only conform to a specific part of the body, resulting in limited applicability.

Adjustable pillows allow a user to adjust the size, shape, or firmness through various means. Some are inflatable, others have different types of inserts, and some are sold in different sizes or shapes. However, many adjustable pillows require additional components that increase the difficulty of adjusting a pillow, creating a tradeoff between customizability and ease of operation.

Known pillows, such as the pillow described in U.S. Pat. No. 7,681,263, do not provide a means for easily repositioning and making minor adjustments to inserts positioned in individual compartments within a pillow. What is more, the degree of customization allowable for each of the different areas of the pillow is lacking, and when it is possible, selectively varying the firmness and/or size of the pillow is a cumbersome process.

Accordingly, there is a need for a modular compartment pillow that allows a user to quickly adjust individual compartments of the pillow and easily customize and conform a pillow to individual preferences.

SUMMARY

In concordance with the instant disclosure, a modular compartment pillow which allows a user to quickly adjust individual compartments of the pillow and easily customize and conform the pillow to individual preferences, has surprisingly been discovered.

In certain embodiments, a modular compartment pillow includes a main body, a plurality of compartments housed in a cavity in the main body, and at least one opening in the main body. The opening in the main body provides access to at least one compartment within the main body.

In certain embodiments, a method for using a modular compartment pillow includes a first step of providing a modular compartment pillow having a main body, a plurality of compartments housed in a cavity in the main body, and at least one opening in the main body, the opening providing access to at least one compartment. Additional steps may include layering one or more inserts, placing the one or more inserts into a corresponding compartment, and adjusting firmness of each compartment by changing the amount and type of insert in each compartment.

In certain embodiments, a kit for a modular compartment pillow includes a modular compartment pillow having a main body, a plurality of compartments housed in a cavity in the main body, at least one opening in the main body, the opening providing access to at least one compartment, and a plurality of inserts which correspond to the size and shape of the plurality of compartments.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION

Figure 1:
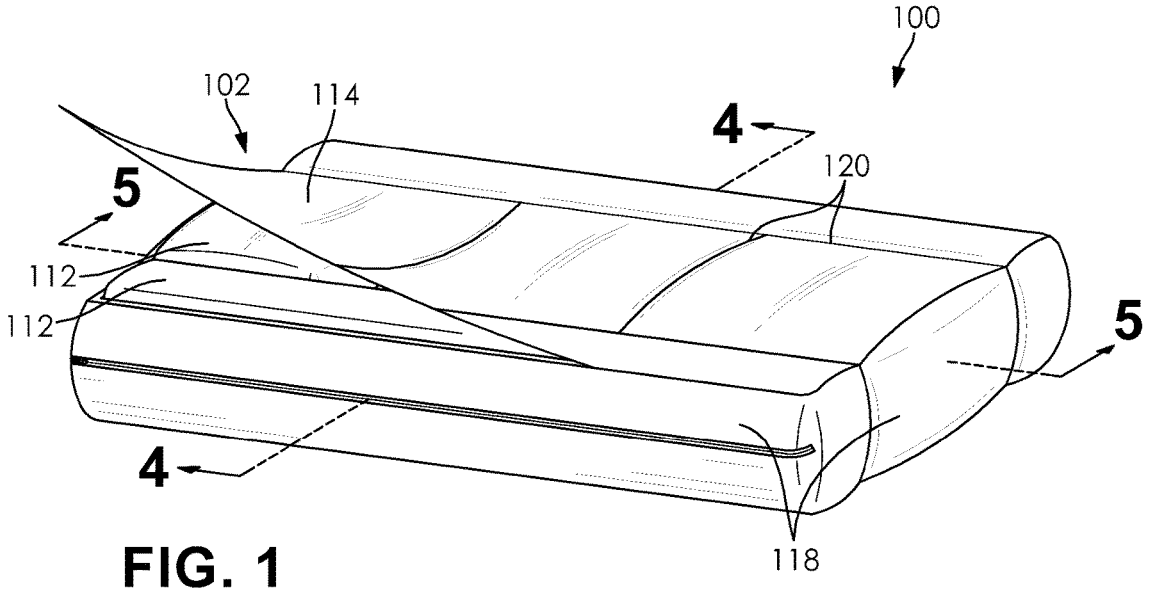
FIG. 1 is a perspective view of a modular compartment pillow according to one embodiment of the present disclosure.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps may be different in various embodiments, including where certain steps may be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

When an element or layer is referred to as being "on," "engaged to," "coupled to," or "coupled to" another element or layer, it may be directly on, engaged, coupled or coupled to the other element or layer, or intervening elements or layers may be present. In contrast, when an element is referred to as being "directly on," "directly engaged to," "directly coupled to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" may encompass both an orientation of above and below. The device may be otherwise oriented (rotated 90 degrees or at other orientations) and the spatially relative descriptors used herein interpreted accordingly.

As shown in FIGS. 1-7, a modular compartment pillow 100 may include a main body 102, one or more compartments 104 housed in a cavity 106 of the main body 102, and one or more openings 108 providing access to the cavity 106 of the main body 102, according to various embodiments. One or more dividing devices, including but not limited to, dividers 110 or separators 120 may be used to separate the compartments 104 and/or secure the compartments 104 within the main body 102. The modular compartment pillow 100 may utilize one or more pillow inserts 112 which may be inserted, removed, and adjusted through the openings 106.

The main body 102 of the modular compartment pillow 100 may be fabricated using any material or combination of materials such as cotton, silk, flannel, and jersey knit, as non-limiting examples. Any suitable material that is soft, comfortable, breathable, lightweight, and durable may be employed, as determined by one of skill in the art. The main body 102 may have any desirable shape, size, and configuration, such as rectangular, square, and circular, as non-limiting examples. The main body 102 may include a top panel 114 and a bottom panel 116 that are integral with or coupled to one another. Alternatively, the top panel and the bottom panel may each be integral with or coupled to one or more side walls 118.

The compartments 104 in the main body 102 may be any desirable shape, size, and configuration. A skilled artisan may select any number of compartments 104 to include with the main body 102. In certain embodiments, one or more of the compartments 104 may be formed or defined using dividing devices, including but not limited to, dividers 110 or separators 120 in the main body 102 of the modular compartment pillow 100. In certain embodiments, the separators 120 may be formed in or coupled to the main body 102 of the modular compartment pillow 100. Alternatively, the separators 120 may be integrally formed on one or more of the top panel 114, bottom panel 116, or side wall 118 of the main body 102, thereby further defining the compartments 104 within the main body 102. As non-limiting examples, the separators 120 may be formed using stitching, elastic, or any combination of suitable materials. A combination of dividers 110 and separators 120 may also be used to form the compartments 104.

Figure 5:
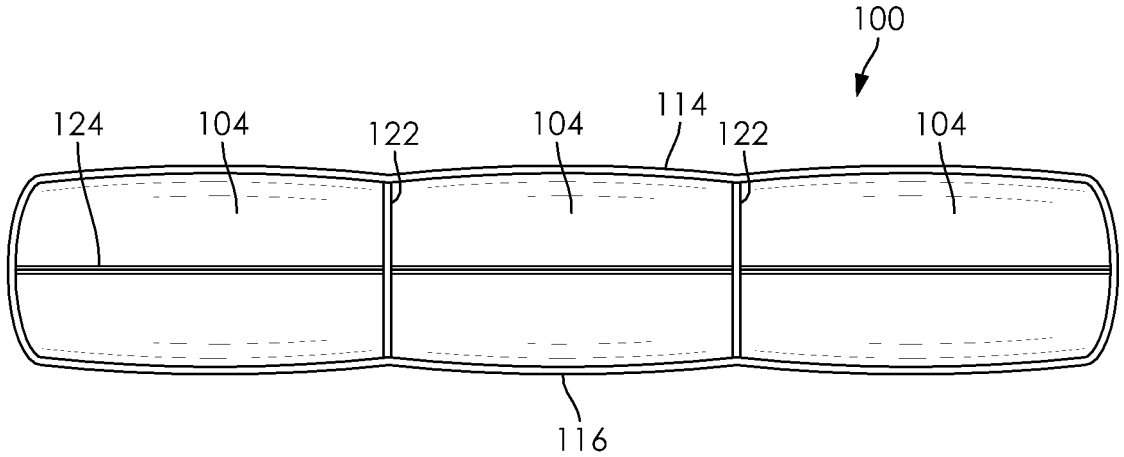
FIG. 5 is a cross-sectional, front elevational view of the modular compartment pillow of FIG. 1, shown at cross-section 5-5 in FIG. 1.

In certain embodiments, the compartments 104 may be adjustable and customizable in shape, size, and height, as non-limiting examples, and/or movable within the main body 102 of the modular compartment pillow 100. The compartments 104 may be integral with or permanently or removably coupled to the main body 102. Each compartment 104 may share one or more common borders 122, as shown in FIG. 5, with one or more other compartments 104. In certain embodiments, the common borders 122 may be the dividers 110 separating adjacent compartments 104. In certain alternative embodiments, the compartments 104 may be housed in but separate and removable from the main body 102. The compartments 104 may be the same or similarly shaped or may be differently shaped. Further, the compartments 104 may be further divided into smaller compartments, according to certain embodiments.

The one or more openings 108 may be integral with or permanently or removably coupled to the main body 102 of the modular compartment pillow 100 using any suitable mechanism, as determined by one of skill in the art. As non-limiting examples, the openings 108 may be zippered openings 124, snap openings (not shown), flap openings 126, slit openings 128, and any combination thereof. Any suitable opening 108 configured to allow the user to access the cavity 106 of the modular compartment pillow 100 and insert, remove, or adjust the pillow inserts 112, as needed, may be employed. The openings 108 may be any desirable shape, size, and configuration, as determined by one of skill in the art to allow insertion of the inserts 112 therethrough. The openings 108 may be uniform in size and shape or may have different sizes and shapes, according to various embodiments.

Figure 4:
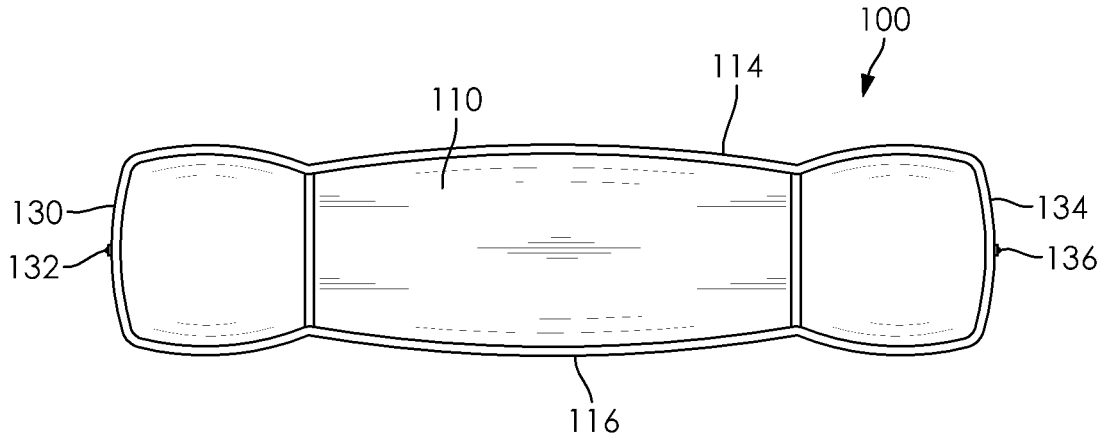
FIG. 4 is a cross-sectional, side elevational view of the modular compartment pillow of FIG. 1, shown at cross-section 4-4 in FIG. 1.

In certain more particular embodiments, as shown in FIG. 4, a first side wall 130 may include a first zippered opening 132 that permits the user to access a portion or all of the cavity 106 of the main body 102 by opening the first zippered opening 132. A second side wall 134 including a second zippered opening 136 that permits the user to access a portion or all of the cavity 106 of the main body 102 by opening the second zippered opening 132. The pillow inserts 112 may be secured in the cavity 106 of the main body 102 by closing the first and second zippered openings 132, 136.

Figure 7:
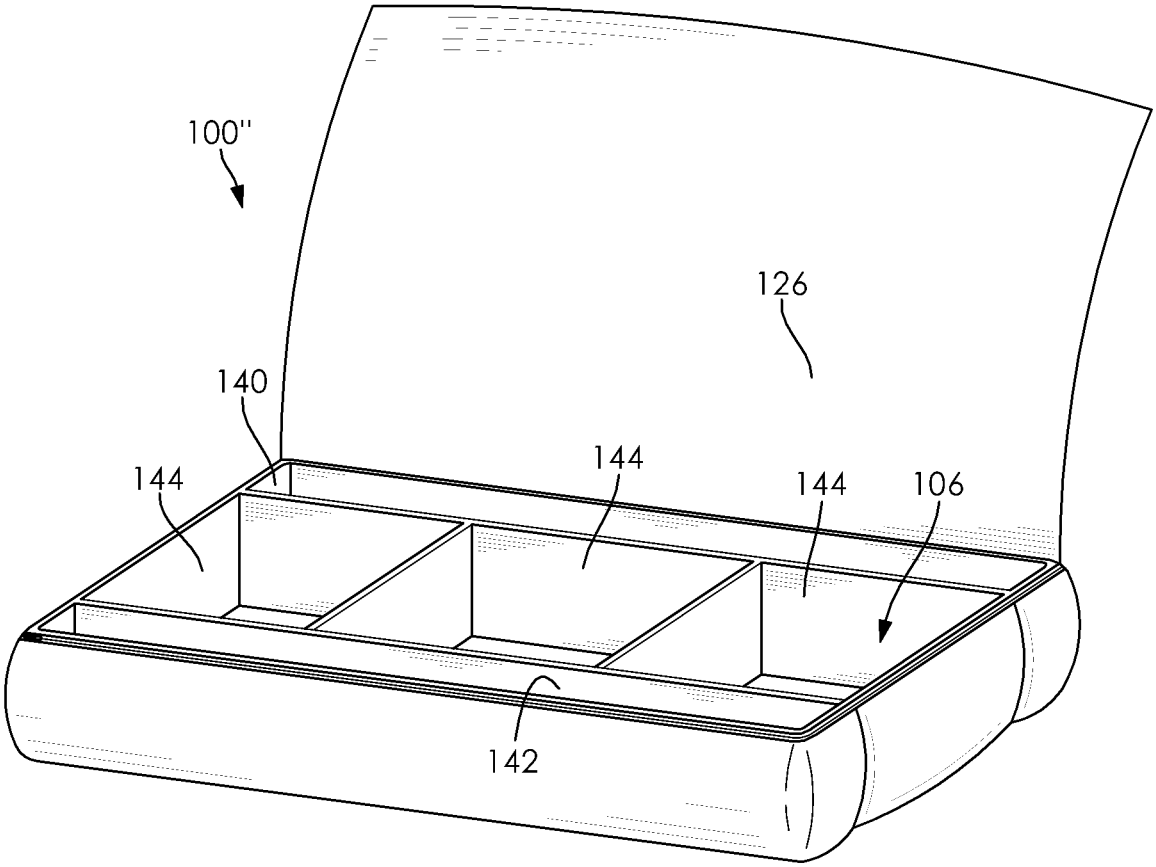
FIG. 7 is a perspective view of a modular compartment pillow according to another embodiment of the present disclosure.

In another more particular embodiment, as shown in FIG. 7, a flap opening 126 formed in the main body 102 may allow the user to access a portion or all of the cavity 106 of the main body 102. According to certain embodiments, the flap opening 126 may be integral with or coupled to the top panel 114.

Figure 6:
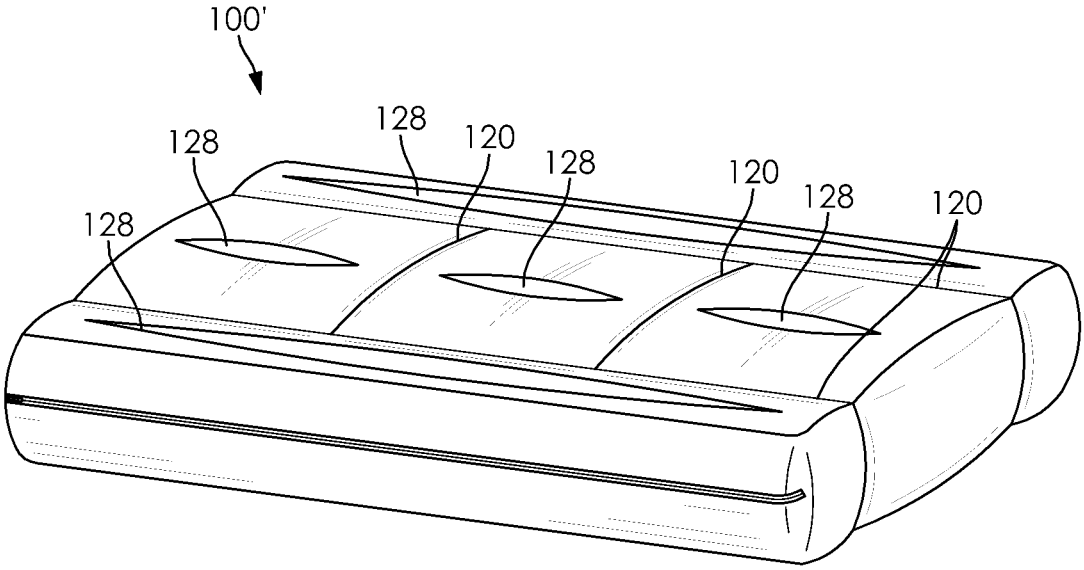
FIG. 6 is a perspective view of a modular compartment pillow according to another embodiment of the present disclosure.

In yet another embodiment, as shown in FIG. 6, the compartments 104 may be individually accessible using slit openings 128 formed in the main body 102 of the modular compartment pillow 100'. It should be appreciated that any number of identical or non-identical openings 108 having any desired configuration may be used to access a portion or all of the cavity 106 of the main body 102.

The dividers 110 may be integral with or permanently or removably coupled to one or both of the main body 102 and one or more compartments 104, according to various embodiments. The dividers 110 may be any suitable shape, size, and configuration. A skilled artisan may select any number of dividers 110 to include in the main body 102. In certain embodiments, the dividers 110 may be used to form, define, or support one or more compartments 104. The dividers 110 may correspond with or engage the separators 120 disposed on of formed in the main body 102 of the modular compartment pillow 100.

In certain embodiments, the dividers 110 may be adjustable and customizable in shape, size, and orientation within the main body 102 and/or movable and removable with respect to the main body 102 of the modular compartment pillow 100. In certain alternative embodiments, the dividers 110 may be housed in but separate and removable from the main body 102. The dividers 110 may be fabricated using any durable material or combination of materials such as cotton and elastic material, as non-limiting examples.

Any number of pillow inserts 112 may be housed in the main body 102 of the modular compartment pillow 100. In certain embodiments, one or both of the shape and size of each pillow insert 112 may correspond with the shape and size of a corresponding compartment 104. In certain more particular embodiments, the shape of each pillow insert 112 may correspond with the shape of a corresponding compartment 104, however the size of each pillow insert 112 may not be the same as the size of the corresponding compartment 104. In one non-limiting example, a height of each pillow insert 112 may be shorter than a height of the corresponding compartment 104, such that more than one pillow insert 112 may be housed or stacked in the corresponding compartment 104.

Each pillow insert 112 may be fabricated using any suitable material or combination of materials. Each pillow insert 112 may include one or more materials selected from a group consisting of: feathers, down, alternative filling, foam, polyfill material, memory foam, cotton, polyester, gel, buckwheat, kapok, wool, latex, combinations thereof, as well as other suitable materials evident to those skilled in the art. In certain embodiments, a plurality of materials may be stacked into layers or otherwise combined to form each pillow insert 112. As a result, a density and firmness of each pillow insert 112 may vary. Likewise, a height or other dimension of each pillow insert 112 may vary. As non-limiting examples, the pillow inserts 112 may be soft, firm, short, tall, or any combination thereof, as desired.

The pillow inserts 112 may be used in combination with one another such that the user may adjust and customize each individual compartment 104 with any desired number and combination of pillow inserts 112. The compartments 104 may include pillow inserts 112 that vary in firmness, density, and various dimensions, as non-limiting examples. In another non-limiting example, one or more compartments 104 may include soft pillow inserts 112, and one or more compartments 104 may include firm pillow inserts 112. It should be appreciated that each of the compartment 104 may include identical or different pillow inserts 112, as determined by the user.

In another more particular embodiment, the pillow inserts 112 may be removably fastened to one another via a number of suitable fasteners (not shown) readily apparent to those of skill in the art including hook and loop fasteners, buttons, zippers, and the like. Certain embodiments may allow the removably fastened pillow inserts 112 to be layered on top of each other, forming multiple layers. One or more of the pillow inserts 112 may be removably fastened to a corresponding compartment 104, thereby militating against movement of the pillow inserts 112 with respect to one or both of the compartments 104 and the main body 102. In certain embodiments, the pillow inserts 112 may be configured to fit tightly in the corresponding compartment 104, thereby militating against movement of the pillow inserts 112 with respect to one or both of the compartments 104 and the main body 102.

In certain embodiments, the pillow inserts 112 of the modular compartment pillow 100 may include a container filled with refrigerant gel (not shown). The pillow inserts 112 with the refrigerant gel may be placed into a cooler or other temperature controlled environment to impart a cooling effect for the modular compartment pillow 100 during use. In certain embodiments, the pillow inserts 112 of the modular compartment pillow 100 may contain a phase change material that imparts an endothermic or exothermic effect. Advantageously, the user may raise or lower the temperature of the modular compartment pillow 100, as desired.

Advantageously, the modular compartment pillow 100 may contain any combination of pillow inserts 112, allowing the user to adjust the density, firmness, height, and temperature, as non-limiting examples, of each compartment 104. Advantageously, the user may adjust or customize the density, firmness, height, temperature, and any combination thereof of each individual compartment by adjusting, changing, adding, and/or removing the pillow inserts 112. Likewise, the pillow inserts 112 may be easily replaced, as needed.

One or both of each pillow insert 112 and the modular compartment pillow 100 may have a removable corresponding pillowcase (not shown) adapted to keep each pillow insert 112 and the modular compartment pillow 100 clean. Advantageously, a user may remove and wash each pillowcase, as needed. The corresponding pillowcase for each pillow insert 112 may have individual compartments allowing a user to insert more than one pillow insert 112 into the corresponding pillowcase, as desired. In certain embodiments, the main body 102 of the modular compartment pillow 100 is configured to be a pillowcase 138. Advantageously, the user may remove the pillow inserts 112 and wash the main body 102, as needed.

In certain embodiments, one or more of the dividers 110 housed in the cavity 106 of the modular compartment pillow 100 and/or one or more of the separators 120 formed in or integral with the main body 102 may form multiple compartments 104. In one non-limiting embodiment of the modular compartment pillow 100", as shown in FIG. 7, the dividers 110 may be configured to form a top compartment 140, a bottom compartment 142, and a plurality of central compartments 144. The top compartment 140 and the bottom compartment 142 may be configured to house long rectangular pillow inserts 112' adapted to support the user's neck. The plurality of central compartments 144 may be configured to house square pillow inserts 112" adapted to support the user's head. It should be appreciated that any shape or combination of shapes, as well as any number of rows and columns, may be used to form the compartments 104 of the modular compartment pillow 100, as determined by one of skill in the art.

In yet another embodiment, as shown in FIGS. 1-5, a combination of dividers 110 and separators 120 may be used to form one or more of the top compartment 140, the bottom compartment 142, and the plurality of central compartments 144. More specifically, one or more separators 120 may be used to define the top compartment 140 and the bottom compartment 142, and one or more dividers 110 disposed in the cavity 106 and extending from the top compartment 140 to the bottom compartment 142 in combination with the separators 120 may be used to define the central compartments 144. Advantageously, the user may access any of the top compartment 140, the bottom compartment 142, and the plurality of central compartments 144 using the zippered opening 124 disposed in the side wall 118 of the main body 102.

In another more particular embodiment, the modular compartment pillow 100' may include slit openings 128 disposed in the main body 102 and adjacent each compartment 104, allowing the user to easily customize select compartments 104, as needed, without having to access the entire cavity 106 of the modular compartment pillow 100', as shown in FIG. 6.

Advantageously, the modular compartment pillow 100 may utilize pillow inserts 112 that correspond to the shape of the compartments 104 of the modular compartment pillow 100. The pillow inserts 112 enable the modular compartment pillow 100 to be adjustable and customizable by size, height, layers, thickness, density, and firmness, as non-limiting examples, in each individual compartment 104 of the modular compartment pillow 100. Adjusting or changing the pillow inserts 112 may enable the modular compartment pillow 100 to best suit different body types, sleeping positions, individual preferences, and provide adjustable cervical spine support. Advantageously, a single user is not limited to one type of pillow and may make adjustments with and during each use of the modular compartment pillow 100.

Figure 8:
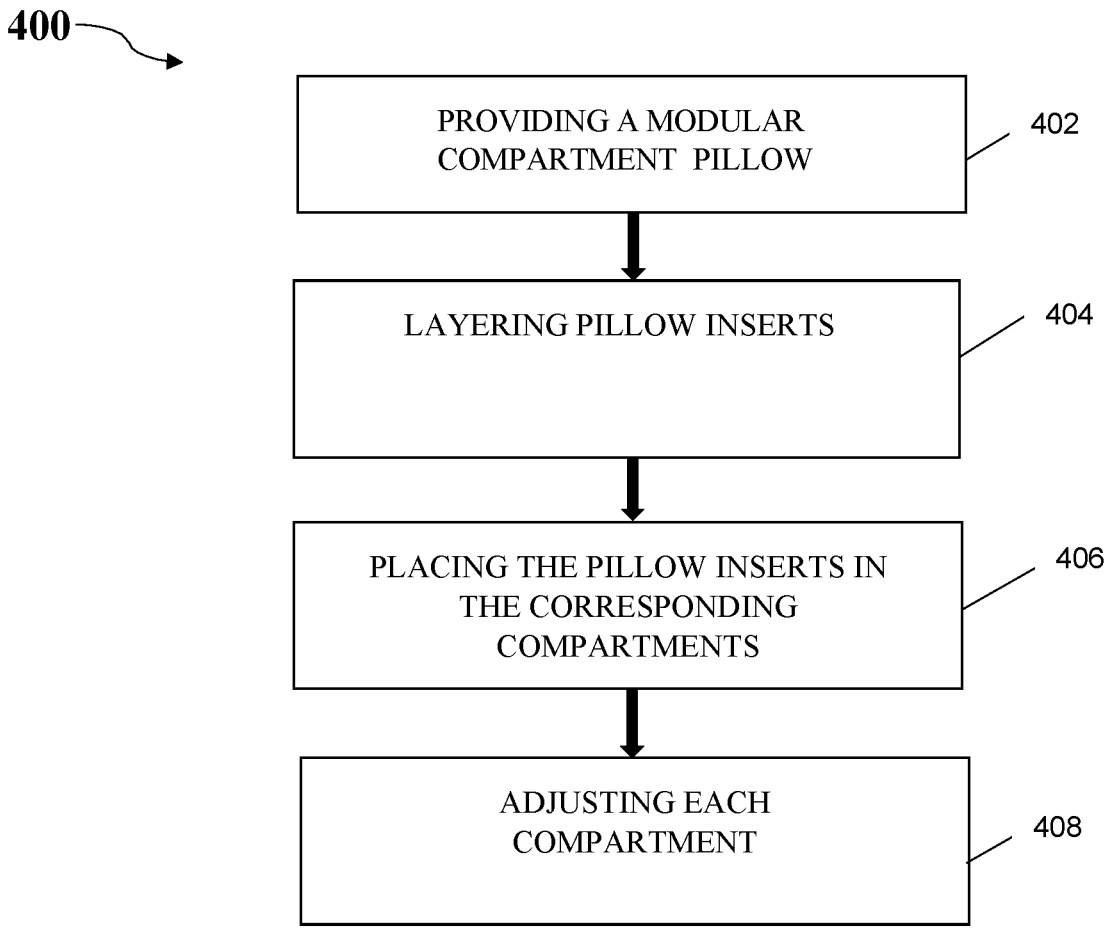
FIG. 8 is a method of using a modular compartment pillow, according to an embodiment of the present disclosure.

With reference to FIG. 8, a method 400 for using the modular compartment pillow 100 may include providing the modular compartment pillow 100 with the main body 102, compartments 104, openings 108, dividing devices, including but not limited to, dividers 110 or separators 120, and pillow inserts 112, as described hereinabove, in a first step 402. A second step 404 may include layering or stacking one or more pillow inserts 112, and a third step 406 may include placing the pillow inserts 112 through the corresponding openings 108 and into each of the corresponding compartments 104. An additional step 408 may include adjusting the firmness of each compartment 104 by changing or adjusting the pillow inserts 112 in each compartment 104, as needed.

It should be appreciated that additional steps may be included, as determined by one of skill in the art. As non-limiting examples, various steps relating to the setup of the modular compartment pillow 100, as well as adjusting and customizing various components and features of the modular compartment pillow 100 may be included. Steps relating to adjusting, customizing, and securing the modular compartment pillow 100 may also be included. The method 400 for using the modular compartment pillow 100 may also include repeating or omitting various steps, as needed.

Figure 2:
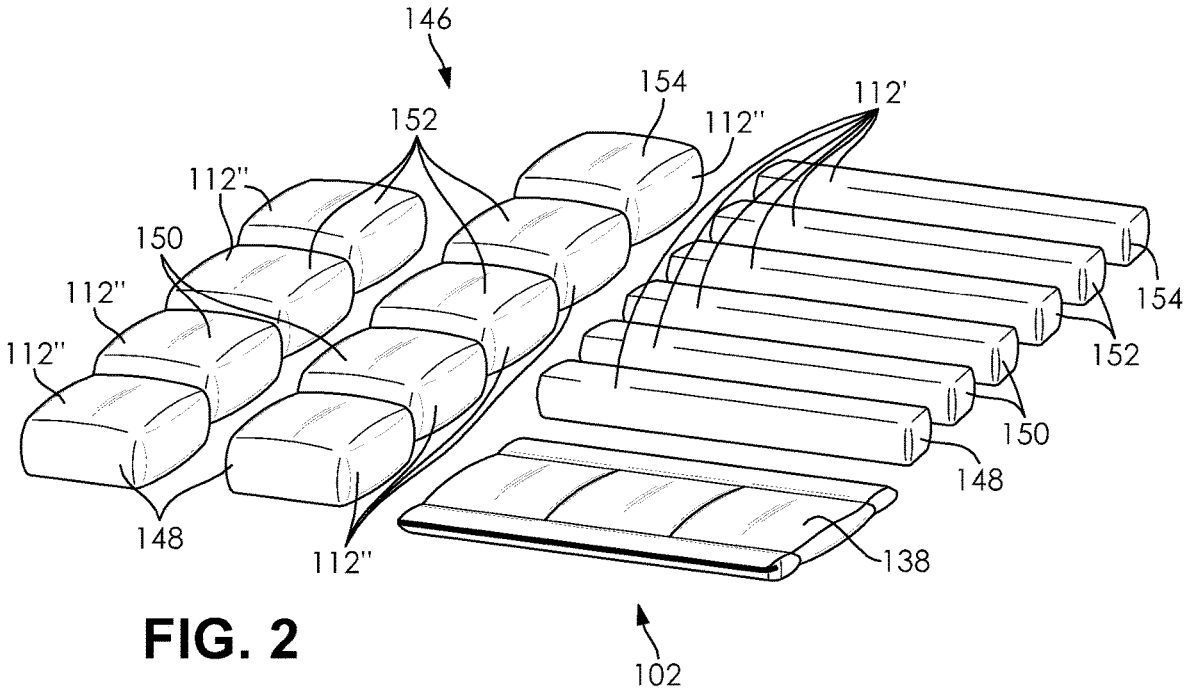
FIG. 2 is a perspective view of the modular compartment pillow kit according to another embodiment of the present disclosure.
Figure 3:
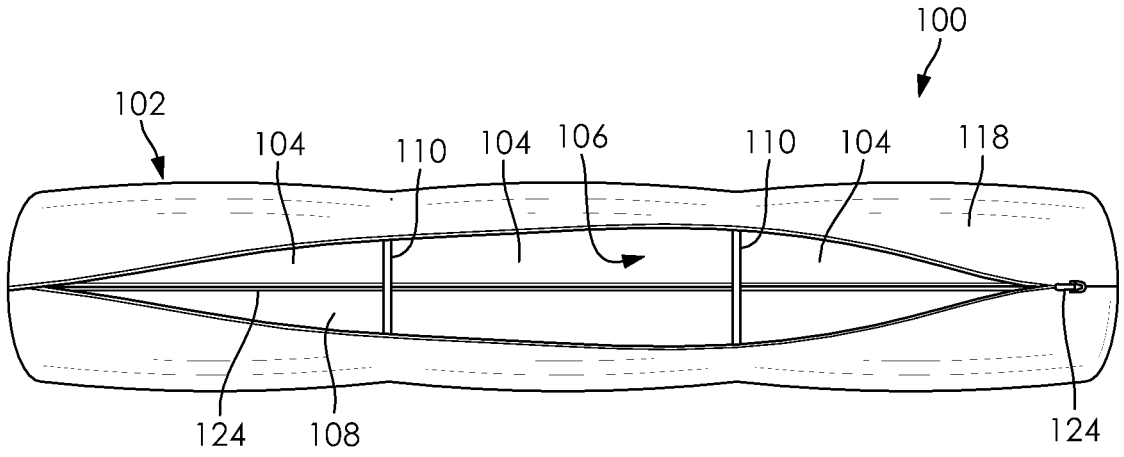
FIG. 3 is a front elevational view of the modular compartment pillow of FIG. 1 shown with the zippered opening in an open position.

As shown in FIG. 2, a kit 500 for a modular compartment pillow 100 may include the modular compartment pillow 100 having the main body 102, one or more compartments 104 disposed in the cavity 108 of the main body 102, and one or more openings 108. Each opening 108 may provide access to one or more corresponding compartments 104. The dividing devices, including but not limited to, dividers 110 or separators 120 may be integral with or permanently or removably connected to one or more of the main body 102 and one or more compartments 104.

The kit 500 may further include the plurality of pillow inserts 146. Each pillow insert 112 of the plurality of pillow inserts 146 may be sized and shaped to fit within a corresponding compartment 104, according to certain embodiments. In one non-limiting example, the kit 500 may include multiple pillow inserts 112 having specific shapes. These pillow inserts 112 may include one or more rectangular pillow inserts 112' and one or more square pillow inserts 112", as determined by a skilled artisan. The pillow inserts 112 of the plurality of pillow inserts 146 may be used in combination with one another thereby allowing the user to adjust and customize each individual compartment 104 with any desired combination of pillow inserts 112. The plurality of pillow inserts 146 may include pillow inserts 112 that vary in firmness and density, as non-limiting examples. In one non-limiting example, the plurality of pillow inserts 146 may include one or more very soft inserts, one or more soft inserts, one or more firm inserts, and one or more very firm inserts. It should be appreciated that the plurality of pillow inserts 146 may include any combination of pillow inserts 112 varying in density, firmness, height, shape, materials, or any other suitable characteristics or features. In a more particular embodiment, the kit 500 may include very soft pillow inserts 148, soft pillow inserts 150, firm pillow inserts 152, and very firm pillow inserts 154. It should be appreciated that any number of varying pillow inserts 112 may be included in the kit 500 to provide the user with numerous options for adjusting and customizing the modular compartment pillow 100.

In certain embodiments, the kit 500 may further include a pillowcase (not shown) configured to cover and protect the main body 102 during use. The pillowcase may be integral with the main body 102 according to various embodiments. Certain examples of the pillowcase may have one or more optional extending sidewalls (not shown) including additional material which may be concealed within the pillowcase using any suitable fastening elements. The additional material may allow the pillowcase to increase in volume when extended.

Example embodiments are provided so that this disclosure will be through and fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, components and methods may be made within the scope of the present technology, with substantially similar results.

What is claimed is:

1. A modular compartment pillow comprising:

a main body;

a plurality of coplanar compartments housed in a cavity in the main body, the plurality of coplanar compartments divided to form a top compartment, a bottom compartment, and three central compartments disposed between the top compartment and the bottom compartment; and at least one opening in the main body, the opening providing access to at least one compartment, wherein:

a length of the top compartment and a length of the bottom compartment are each equivalent to a sum of a length of each of the three central compartments, a width of each of the central compartments is greater than a width of the top compartment and a width of the bottom compartment, and a height of each of the central compartments is equivalent to a height of the top compartment and a height of the bottom compartment.

2. The modular compartment pillow of claim 1, wherein one or more of the compartments are formed by at least one dividing means disposed in the cavity of the main body.

3. The modular compartment pillow of claim 2, wherein the dividing means is at least one separator integral within the main body of the modular compartment pillow.

4. The modular compartment pillow of claim 1, wherein the compartment includes at least one dividing means disposed in the cavity of the main body configured to form the top compartment, the bottom compartment, and the three central compartments.

5. The modular compartment pillow of claim 1, further comprising:

at least one insert, each insert corresponding to a size and a shape of a corresponding compartment.

6. The modular compartment pillow of claim 5, wherein each insert can be inserted and removed from a corresponding compartment using at least one opening.

7. The modular compartment pillow of claim 5, wherein each insert can be removably fastened to another insert.

8. The modular compartment pillow of claim 5, wherein each insert includes a plurality of stacked materials.

9. The modular compartment pillow of claim 5, wherein the insert is being maintained within one or more of the compartments formed by at least one dividing means disposed in the cavity of the main body.

10. The modular compartment pillow of claim 5, wherein each insert includes a member selected from a group consisting of feathers, down, alternative filling, foam, polyfill material, memory foam, cotton, polyester, gel, buckwheat, kapok, wool, latex, and combinations thereof.

11. The modular compartment pillow of claim 5, wherein each insert contains a phase change material that imparts an endothermic or exothermic effect.

12. The modular compartment pillow of claim 5, wherein at least one insert is a long rectangular insert and at least one insert is a square insert.

13. The modular compartment pillow of claim 12, wherein the long rectangular insert is configured to be removably disposed within only the top compartment and the bottom compartment.

14. The modular compartment pillow of claim 12, wherein the square insert is configured to be removably disposed within each of the three central compartments.

15. The modular compartment pillow of claim 1, wherein one or both of at least one divider disposed in the cavity of the main body and at least one separator integral with the main body create five compartments in the cavity of the main body.

16. The modular compartment pillow of claim 15, wherein the five compartments include three rows with a center row having three columns.

17. A method of using a modular compartment pillow, comprising the steps of:

providing the modular compartment pillow having a main body, a plurality of coplanar compartments housed in a cavity in the main body, the plurality of coplanar compartments divided to form a top compartment, a bottom compartment, and three central compartments disposed between the top compartment and the bottom compartment, and at least one opening, the opening providing access to at least one compartment, wherein a length of the top compartment and a length of the bottom compartment are each equivalent to a sum of a length of each of the three central compartments, a width of each of the central compartments is greater than a width of the top compartment and a width of the bottom compartment, and a height of each of the central compartments is equivalent to a height of the top compartment and a height of the bottom compartment;

layering one or more inserts;

placing the one or more inserts into a corresponding compartment; and adjusting a firmness of each compartment by changing the amount and type of insert in each compartment.

18. The method of claim 17, wherein each insert corresponds to a size and a shape of the corresponding compartment.

19. A kit for a modular compartment pillow, comprising:

a modular compartment pillow comprising:

a main body;

a plurality of coplanar compartments housed in a cavity in the main body, the plurality of coplanar compartments divided to form a top compartment, a bottom compartment, and three central compartments disposed between the top compartment and the bottom compartment wherein a length of the top compartment and a length of the bottom compartment are each equivalent to a sum of a length of each of the three central compartments, a width of each of the central compartments is greater than a width of the top compartment and a width of the bottom compartment, and a height of each of the central compartments is equivalent to a height of the top compartment and a height of the bottom compartment;

at least one opening in the main body, the opening providing access to at least one compartment; and a plurality of inserts which correspond to the size and shape of the plurality of compartments.

20. The kit of claim 19, wherein the kit includes a plurality of long rectangular inserts and a plurality of square inserts.

* * * * *